US005187476A

United States Patent [19]

Hamer

[11] Patent Number: 5,187,476

[45] Date of Patent: Feb. 16, 1993

[54] OPTICAL TRAFFIC PREEMPTION DETECTOR CIRCUITRY

[75] Inventor: Steven M. Hamer, Willernie

[73] Assignee: Minnesota Mining and Manufacturing Company, St. Paul, Minn.

[21] Appl. No.: 720,894

[22] Filed: Jun. 24, 1991

[51] Int. Cl.[5] ..... G08G 1/07

[52] U.S. Cl. ..... 340/906; 340/901; 340/902; 340/904

[58] Field of Search ..... 340/901, 902, 903, 904, 340/906, 907, 942; 359/189, 154, 142, 149, 150

[56] References Cited

U.S. PATENT DOCUMENTS

| | | | |
|---|---|---|---|
| 2,620,470 | 12/1952 | Rather, Jr. et al. | 359/142 |
| 4,162,477 | 7/1979 | Munkberg | 340/906 |
| 4,806,931 | 2/1989 | Nelson | 340/906 |

*Primary Examiner*—Jin F. Ng
*Assistant Examiner*—Dov Popovici
*Attorney, Agent, or Firm*—Gary L. Griswold; Walter N. Kirn; William B. Barte

[57] ABSTRACT

An optical traffic preemption detector detects pulses of light emitted by an approaching emergency vehicle and provides an output signal which is processed by a phase selector. The phase selector can request a traffic signal controller to preempt a normal traffic signal sequence to give priority to the emergency vehicle. A detector assembly is mounted in proximity to an intersection and can have multiple detector channels. A detector channel can have multiple photocells. Each photocell is provided with a rise time filter. If a detector channel has more than one photocell, the outputs of the respective rise time filters are coupled together. An output of a rise time filter, or coupled rise time filters, is first applied to a current-to-voltage converter and then a band pass filter. The band pass filter isolates a decaying sinusoid signal from a signal representative of a pulse of light. The decaying sinusoid signal is processed to produce a detector channel output signal that has a number of pulses for each pulse of light.

21 Claims, 7 Drawing Sheets

OPTICAL TRAFFIC PREEMPTION DETECTOR CIRCUITRY

REFERENCE TO CO-PENDING APPLICATION

Reference is made to a co-pending application entitled "OPTICAL TRAFFIC PREEMPTION DETECTOR" filed on even date with this application and assigned to the same assignee.

BACKGROUND OF THE INVENTION

This invention relates to a system that allows emergency vehicles to remotely control traffic signals, and more specifically, a detector for use in such a system, wherein the detector receives pulses of light from an approaching emergency vehicle and transmits a signal representative of the distance of the approaching vehicle to a phase selector, which can issue a preemption request to a traffic signal controller.

Traffic signals have long been used to regulate the flow of traffic at intersections. Generally, traffic signals have relied on timers or vehicle sensors to determine when to change traffic signal lights, thereby signaling alternating directions of traffic to stop, and others to proceed.

Emergency vehicles, such as police cars, fire trucks and ambulances, generally have the right to cross an intersection against a traffic signal. Emergency vehicles have typically depended on horns, sirens and flashing lights to alert other drivers approaching the intersection that an emergency vehicle intends to cross the intersection. However, due to hearing impairment, air conditioning, audio systems and other distractions, often the driver of a vehicle approaching an intersection will not be aware of a warning being emitted by an approaching emergency vehicle. This can create a dangerous situation when an emergency vehicle seeks to cross an intersection against a traffic signal and the driver of another vehicle approaching the intersection is not aware of the warning being emitted by the emergency vehicle.

This problem was first successfully addressed in U.S. Pat. No. 3,550,078 (Long), which is assigned to the same assignee as the present application. The Long patent discloses an emergency vehicle with a stroboscopic light, a plurality of photocells mounted along an intersection with each photocell looking down an approach to the intersection, a plurality of amplifiers which produce a signal representative of the distance of the approaching emergency vehicle, and a phase selector which processes the signal from the amplifiers and can issue a request to a traffic signal controller to preempt a normal traffic signal sequence to give priority to the approaching emergency vehicle.

The Long patent discloses that as an emergency vehicle approaches an intersection, it emits a series of light pulses at a predetermined rate, such as 10 pulses per second, and with each pulse having a duration of several microseconds. A photocell, which is part of a detector channel, receives the light pulses emitted by the approaching emergency vehicle. An output of the detector channel is processed by the phase selector, which then issues a request to a traffic signal controller to change to green the traffic signal light that controls the emergency vehicle's approach to the intersection.

In the Long patent, each detector channel is comprised of two photocells in parallel with an inductor. The photocells also act as capacitors, so that the photocells and the inductor form an LC resonant circuit. The resonant circuit is tuned to oscillate at a predetermined frequency, such as 6 KHz. The capacitance of the photocells and the inductance of the inductor determine the frequency of oscillation.

The inductor also acts as a DC short. Without the inductor, a constant or slowly changing light source, such as the sun or an approaching car headlight, would saturate the photocells and render them ineffective. Therefore, the inductor also acts to make the resonant circuit respond only to quickly changing inputs.

When a photocell is presented with a pulse of light, the resonant circuit produces a decaying sinusoid signal. The signal is amplified and sent to the phase selector. By measuring the magnitude of the decaying sinusoid signal, the phase selector can determine the distance of the approaching emergency vehicle.

Because the system taught by Long is dependent upon the capacitance of the photocells and the inductance of the inductor to produce the predetermined oscillation frequency, each detector channel must always have two photocells. In a typical intersection, there are four approaches. For example, one street may approach an intersection from the east and west and another may approach the intersection from the north and south. In one embodiment, the two photocells in a detector channel can be aimed in opposite directions, for example, one aimed north and the other aimed south. Another detector channel is used for the other street, with one photocell aimed east and the other aimed west. If an emergency vehicle approaches, say from the south, the photocell that is pointed south will activate the north-south detector channel. The detector channel output signal will be processed by the phase selector which will then issue a request to the traffic signal controller to change the traffic signal lights to green in the north and south direction and to red in the east and west direction. The traffic signal lights are now set such that the emergency vehicle can proceed through the intersection and cross traffic will be required to stop.

In another embodiment, a typical four approach intersection will use four detector channels, with each detector channel having its two photocells pointed in approximately the same direction. In this embodiment, when an approaching emergency vehicle is detected, the traffic signal lights on three of the approaches will change to red. The traffic signal lights controlling the emergency vehicle's approach will change to green.

This embodiment requires four more photocells than are physically needed to detect all approaches because the detector circuit disclosed by Long must have two photocells per detector channel to create the capacitance required for the resonant circuit to oscillate at the predetermined frequency. Long does not disclose a circuit or method that can have a variable number of photocells per detector channel.

The resonant circuit disclosed by Long creates another problem; the inductor acts as an antenna and induces noise into the circuit. The detector circuit requires extensive shielding to minimize noise.

U.S. Pat. No. 4,704,610 (Smith et al) also discloses an emergency vehicle traffic control system. The Smith et al patent discloses an emergency vehicle that transmits infrared energy to a receiver mounted near an intersection. The infrared energy transmitted by the emergency vehicle preferably has a wavelength centered at approximately 0.950 micrometers and is modulated with a 40 KHz carrier.

The infrared receiver of Smith et al is comprised of a photovoltaic detector in parallel with a tunable inductor. The tunable inductor is adjusted to allow only signals modulated with a 40 KHz carrier to be detected by the amplifier/demodulator circuit. The tuned photovoltaic detector/inductor circuit effectively eliminates DC signals from background solar radiation.

The detector circuit disclosed by Smith et al suffers from the same problems as the detector circuit disclosed by Long; it is impossible to change the number of photocells per detector channel without having to retune a resonant circuit to maintain a predetermined frequency. Also, the inductor disclosed by Smith et al, like the inductor disclosed by Long, is likely to act as an antenna and therefore introduce radio frequency noise into the detector circuit.

SUMMARY OF THE INVENTION

This invention provides a detector circuit that is constructed without an inductor or LC resonant circuit. The invention utilizes a photocell module that has a photocell and a rise time filter. The rise time filter allows only quickly changing electrical signals to pass. The photocell module receives pulses of light from an approaching emergency vehicle and produces a current signal with an amplitude which varies with the intensity of the pulses of light emitted by the approaching emergency vehicle. The current signals produced by one photocell module or multiple photocell modules are summed and presented to a current-to-voltage (I/V) converter. The I/V converter produces a voltage signal.

A voltage signal which has a sharp pulse representative of a pulse of light emitted by an emergency vehicle is passed through a band pass filter having a predetermined center frequency, such as 6.5 KHz. The band pass filter isolates a decaying sinusoid signal from the spectrum of frequencies present in the sharp pulse. The invention also employs an output power amplifier which provides a signal, based on the decaying sinusoid signal, which is capable of being sent to a phase selector not in proximity with the detector channel.

DETAILED DESCRIPTION OF THE PREFERRED EMBODIMENTS

Figure 1:
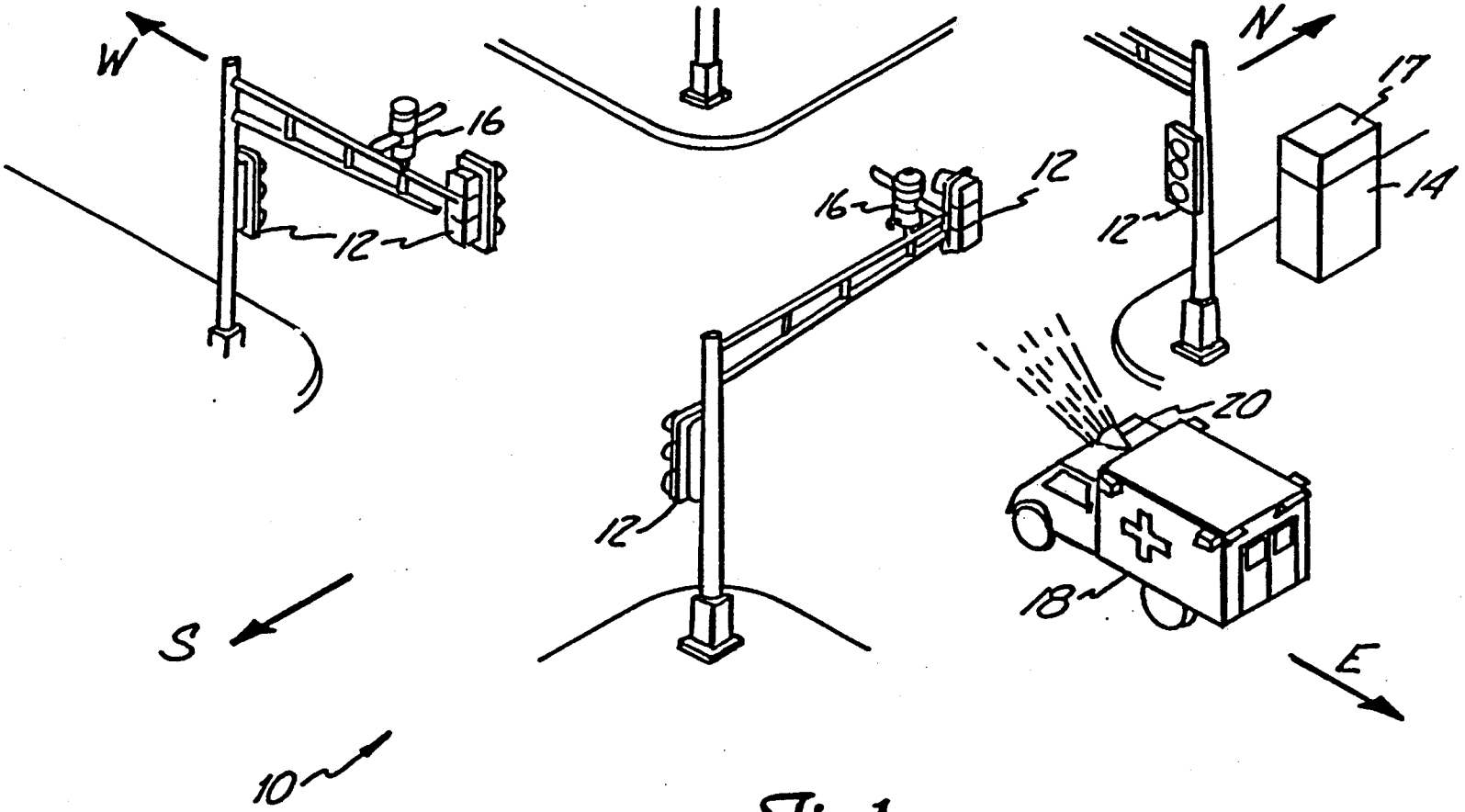
FIG. 1 is a perspective view of a traffic intersection which employs the detector assembly of the present invention.

FIG. 1 is an illustration of a typical intersection 10 with traffic signal lights 12. Traffic signal controller 14 sequences traffic signal lights 12 to allow traffic to proceed alternately through the intersection. Detector assemblies 16 are mounted to detect pulses of light emitted by emergency vehicles approaching intersection 10. Detector assemblies 16 communicate with phase selector 17, which is typically located in the same cabinet as traffic controller 14.

In FIG. 1, emergency vehicle 18 is approaching intersection 10. It is likely that the traffic light 12 controlling approaching emergency vehicle 18 will be red as emergency vehicle 18 approaches the intersection.

Mounted on emergency vehicle 18 is optical transmitter 20, which transmits pulses of light to detector assembly 16. Optical transmitter 20 emits pulses of light at a predetermined interval, such as 10 pulses per second. Each pulse of light has a duration of several microseconds. Detector assembly 16 receives these pulses of light and sends an output signal to phase selector 17. Phase selector 17 processes the output signal from detector assembly 16 and issues a request to traffic signal controller 14 to preempt a normal traffic signal sequence. In FIG. 1, if optical transmitter 20 on emergency vehicle 18 emits pulses of light at the predetermined interval, with each pulse having sufficient intensity and fast enough rise time, phase selector 17 will request traffic signal controller 14 to cause the traffic signal lights 12 controlling the northbound and southbound directions to become red and the traffic signal lights controlling the westbound direction to become green.

In one embodiment, phase selector 17 requests that only the traffic signal lights that control an approaching emergency vehicle to become green, and the traffic signal lights controlling the other three approaches become red. In another embodiment, phase selector 17 requests that the traffic signal lights controlling the street on which the emergency vehicle is approaching to become green in both directions. The traffic signal lights controlling the street perpendicular to the emergency vehicle's approach are changed to red. The difference between these two embodiments is that the former embodiment requires four channels and the latter embodiment requires two channels. If two channels are employed, two photo detectors pointing in opposite directions activate the same channel. If four channels are employed, each photocell activates its own channel.

Figure 2:
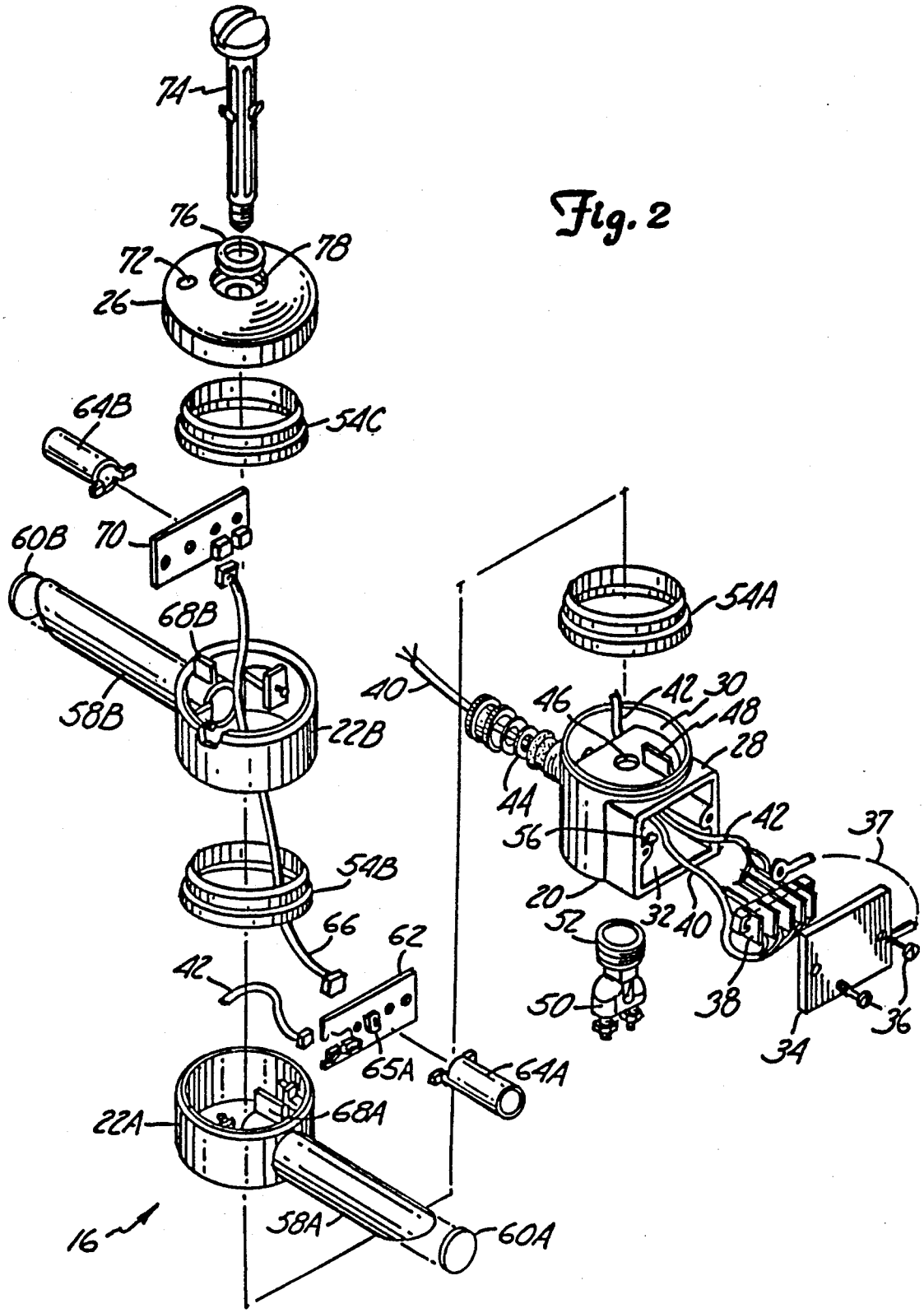
FIG. 2 is an exploded view of one of the detector assemblies of FIG. 1.

FIG. 2 is an exploded view of detector assembly 16 of FIG. 1. Detector assembly 16 includes base unit 20, detector turrets 22A and 22B and cap 26.

Base unit 20 is a cylindrical shaped housing having rectangular projection 28 and circular opening 30. Rectangular opening 32 is located on rectangular projection 28. When detector assembly 16 is assembled, cover 34 is fastened over rectangular opening 32 by screws 36. When cover 34 is removed, cover 34 retains screws 36 and is kept in proximity to base unit 20 by tether 37. Terminal strip 38 is connected to wires from cables 40 and 42. Cable 40 enters base unit 20 through cable entry port 44. Near circular opening 30 are threaded center shaft hole 46 and stop plate 48. Span wire clamp 50 has threaded portion 52, which can be screwed into threaded hole 80 (shown in FIG. 3A). When detector assembly 16 is assembled, gasket 54A is positioned between detector turret 22A and base unit 20.

Base unit 20 serves as a point of attachment for mounting detector assembly 16 near an intersection. Detector assembly 16 can be installed in one of two ways; upright, with base unit 20 at the bottom of detector assembly 16, or inverted, with base unit 20 at the top of detector assembly 16. Weep hole 56 can be opened by knocking out a plug if detector assembly 16 is installed in the upright position. Weep hole 56 allows accumulated moisture to dissipate from the interior of detector assembly 16.

If detector assembly 16 is installed on a mast arm of a traffic control signal, detector 16 can be installed in either the upright or the inverted position. If the mast arm is hollow and can carry wiring, cable 40 can enter detector assembly 16 through the same threaded hole 80 (shown in FIG. 3A) that is used to mount detector assembly 16 to the mast arm. However, if the mast arm can not carry wiring, or it is not convenient to route cable 40 through threaded hole 80, cable 40 can enter detector assembly 16 through cable entry port 44.

If detector assembly 16 is mounted to a span wire, detector assembly 16 is typically mounted in the inverted position. Span wire clamp 50 is clamped to the span wire, and threaded portion 52 of clamp 50 is screwed into threaded hole 80 of base unit 20. Detector assembly 16 is suspended in the inverted position from the span wire. In this type of installation, cable 40 must enter detector assembly 16 though cable entry port 44.

When detector assembly 16 is assembled, terminal strip 38 is positioned inside an interior of base unit 20. Terminal strip 38 connects cable 40, which leads to phase selector 17 of FIG. 1, to cable 42, which leads to detector turret 22A. One cable 42 is required for each detector channel. In the embodiment shown in FIG. 2, there are two photocells coupled to one detector channel. Therefore, only one cable 42 is required. However, in other embodiments detector assembly 16 can include more than one channel, and therefore there would be more than one cable 42 having wires connected to terminal strip 38.

Circular opening 30 rotatably supports gasket 54A and detector turret 22A. Stop plate 48 contacts a stop plate in detector turret 22A to prevent detector turret 22A form rotating more than 360 degrees with respect to base unit 20. Threaded center shaft hole 46 is provided to receive a threaded shaft, which holds detector assembly 16 together.

Detector turret 22A includes tube 58A, which has an opening covered by window 60A. When detector assembly 16 is assembled, master circuit board 62 is positioned within detector turret 22A, with integrally formed lens and lens tube 64A coupled to master board 62 and extending into tube 58A. Integrally formed lens and lens tube 64A is positioned in front of photocell 65A. Cable 42 connects master circuit board 62 with terminal strip 38. Cable 66 connects circuit board 62 with circuitry in detector turret 22B. Detector turret 22A also has stop plate 68A and a stop plate beneath tube 58A (not shown in FIG. 2).

Tube 58A provides a visual indication of the direction in which integrally formed lens and lens tube 64A is aimed. This is helpful to installers and maintainers of detector assembly 16 because they can determine from street level the direction a detector turret is aimed. Window 60A is provided to prevent spiders and other insects or small animals from entering detector assembly 16 and creating obstructions (such as spider webs). It also shields detector assembly 16 from rain, snow and other elements.

Integrally formed lens and lens tube 64A is coupled to master circuit board 62 and directs light entering tube 58A to photocell 65A. The lens in integrally formed lens and lens tube 64A is a wide aperture lens that intensifies the light striking photocell 65A and also selects a field of view of approximately eight degrees.

Cable 42 connects master circuit board 62 through terminal strip 38 and cable 40 to phase selector 17 in FIG. 1. Cable 42 provides a power supply voltage to master circuit board 62 and returns a detector channel output signal from master circuit board 62 to phase selector 17. Cable 66 connects master circuit board 62 to an auxiliary circuit board in detector turret 22B. Gasket 54B separates detector turret 22A from detector turret 22B and seals the rotatable interface between the two detector turrets from moisture, dirt and other elements.

Detector turret 22B is similar to detector turret 22A. Detector turret 22B has tube 58B, window 60B, integrally formed lens and lens tube 64B, photocell 65B (shown in FIG. 6), stop plate 68B and a stop plate beneath tube 58B (not seen in FIG. 2). However, unlike detector turret 22A, detector turret 22B has auxiliary circuit board 70.

Auxiliary circuit board 70 has a small subset of the circuitry on master circuit board 62. When photocell 65B receives a pulse of light, a signal is sent via cable 66 to master circuit board 62. Master board 62 processes the signal and sends it to phase selector 17 in FIG. 1. In the embodiment shown in FIG. 2, phase selector 17 cannot determine whether the output signal of detector assembly 16 originated from photocell 65B on auxiliary circuit board 70 or photocell 65A on master circuit board 62.

When detector assembly 16 is assembled, gasket 54C seals the interface between detector turret 22B and cap 26 from moisture, dirt and other elements. Like weep hole 56 in base unit 20, weep hole 72 in cap 26 can be opened by knocking out a plug if detector assembly 16 is to be installed in an inverted position.

Center shaft 74 extends through O-ring 76, hole 78 in cap 26, detector turrets 22B and 22A and associated gaskets, to threaded center shaft hole 46 in base unit 20. After installing detector assembly 16 and aiming the detector turrets in the proper direction, center shaft 74 is tightened to lock detector turrets 22A and 22B in place and hold detector assembly 16 together.

Base unit 20, detector turrets 22A and 22B and cap 26 preferably are comprised of a material such as molded polycarbonate plastic. The material must be opaque to electromagnetic radiation in the visible and infra-red spectra to insure proper operation of the detector circuitry. Such a polycarbonate plastic is manufactured by Mobay. The Mobay product number for this material is M39L1510.

Figure 3A:
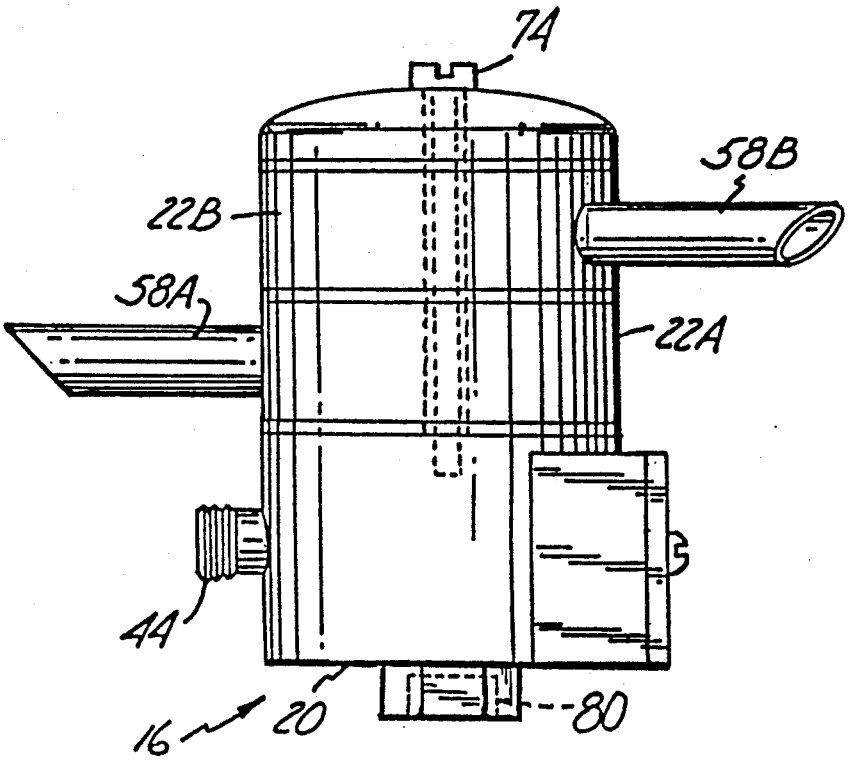
FIG. 3A is a side view of an assembled detector assembly of FIG. 2.

FIG. 3A shows an assembled detector assembly 16 of FIG. 2. In addition to the elements shown in FIG. 2, FIG. 3A shows threaded hole 80, for mounting detector assembly 16 to a traffic signal mast arm or span wire clamp 50 of FIG. 2.

Tubes 58A and 58B have ends which are cut at an angle. Detector assembly 16 is always installed with the tubes positioned such that the shorter side of each tube 58A and 58B is closer to the ground. FIG. 3A shows detector assembly 16 assembled for installation in the upright position. If detector assembly 16 is to be mounted in the inverted position, detector turrets 22A and 22B would have to be inverted so that when detector assembly 16 is inverted, the shorter side of each tube is closer to the ground.

Figure 3B:
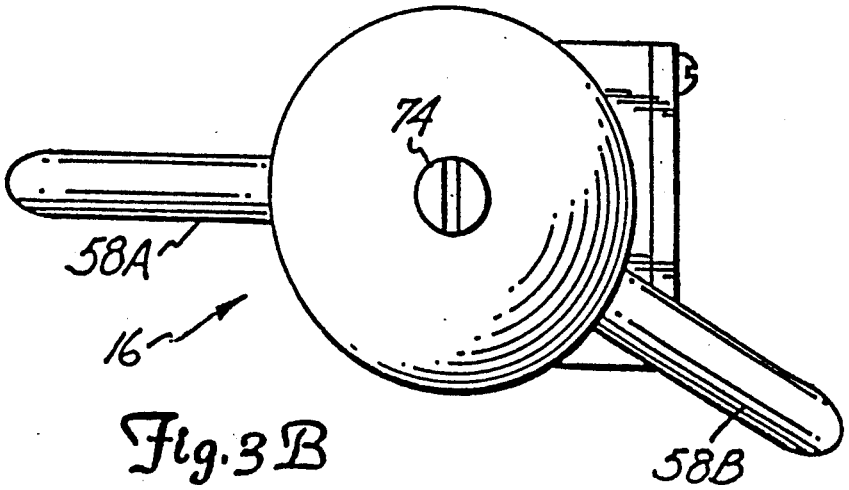
FIG. 3B is a top view of the assembled detector assembly shown in FIG. 3A.

FIG. 3B is a top view of the detector assembly 16 shown in FIG. 3A. FIG. 3B illustrates, by having tubes 58A and 58B separated by an angle of less than 180 degrees, how tubes 58A and 58B can be adjusted to adapt to the topography of the intersection where detector assembly 16 will be installed.

Figure 4A:
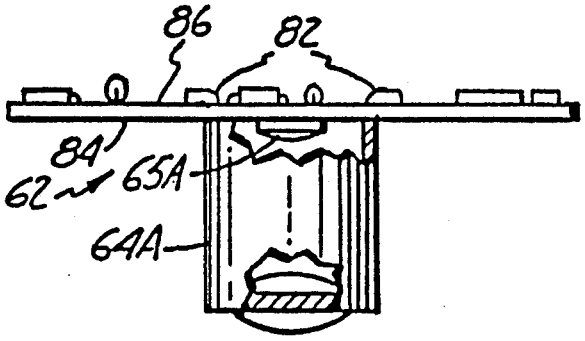
FIG. 4A is a side view of a master circuit board, which is part of the detector assembly of FIG. 2.

FIG. 4A is a side view of master circuit board 62 of FIG. 2. Master circuit board 62 has photocell side 84, which includes photocell 65A and integrally formed lens and lens tube 64A, and component side 86, which includes the components that form the detector circuitry.

Integrally formed lens and lens tube 64A is attached to master circuit board 62 by two retainment tabs 82 that protrude through master circuit board 62. Integrally formed lens and lens tube 64A is preferably formed of polycarbonate plastic by an injection molding process. This material and process provides cost advantages, excellent resistance to high temperatures, and superior alignment with respect to photocell 65A. The lens has an aperture of approximately f 1.0, a diameter of approximately 0.644 inches, a maximum thickness at its center of approximately 0.218 inches, and selects a field of view of approximately 8 degrees.

Figure 4B:
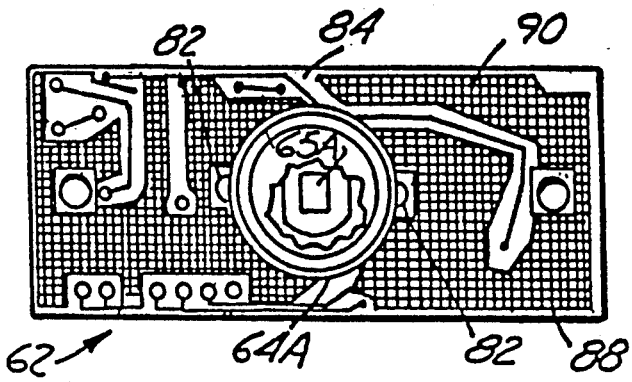
FIG. 4B is a front view of a photocell side of the master circuit board shown in FIG. 4A.

FIG. 4B is a front view of photocell side 84 of master circuit board 62. In addition to the elements shown in FIG. 4A, FIG. 4B shows ground plane grid 90. Ground plane grid 90 helps prevent electrical noise emanating from component side 86 from interfering with the operation of photocell 65A on detector side 84 by shielding the two sides from each other. Because many of the components on master circuit board 62 are surface mounted, the component terminals do not have to protrude through the board. This further enhances the shielding effect of ground plane grid 90.

Photocell side 84 of master circuit board 62 is nearly the same as a photocell side on auxiliary circuit board 70 of FIG. 2. Auxiliary circuit board 70 has photocell 65B, integrally formed lens and lens tube 64B and a ground plane grid on a photocell side in an arrangement similar to that shown in FIG. 4B. Although auxiliary circuit board 70 and master circuit board 62 have photocell sides that are similar, their component sides are different.

Figure 5A:
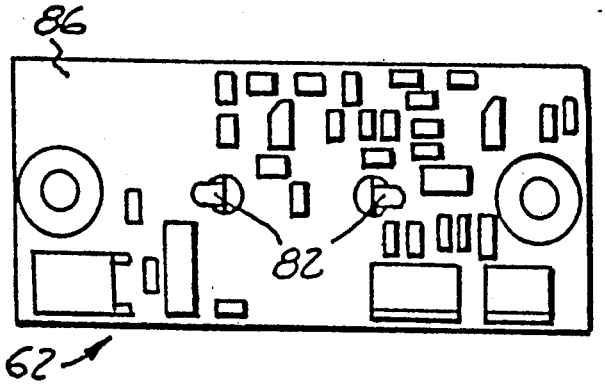
FIG. 5A is a front view of a component side of the master circuit board of FIG. 4A.

FIG. 5A shows component side 86 of master circuit board 62. Component side 86 is fully populated with the components necessary to form a detector channel. Also shown in FIG. 5A are retainment tabs 82, which couple integrally formed lens and lens tube 64A of FIG. 4A to master circuit board 62.

Figure 5B:
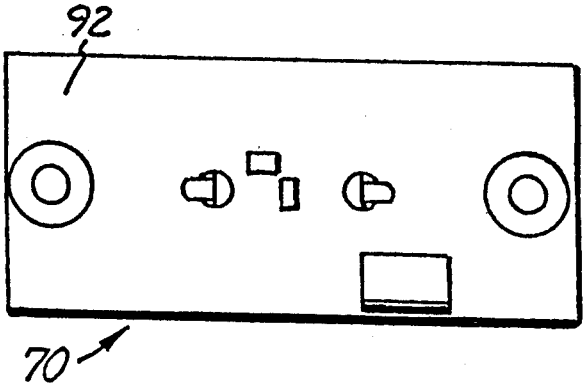
FIG. 5B is a front view of a component side of an auxiliary circuit board used in the detector assembly of FIG. 2.

FIG. 5B shows component side 92 of auxiliary circuit board 70. Component side 92 is only partially populated. The only circuitry that component side 92 has is a filter formed from a resistor and a capacitor, and a connector which connects an auxiliary circuit board 70 to a master circuit board 62. Master circuit board 62 then performs signal processing on a signal combined from signals originating from photocell 65A on master circuit board 62 and photocell 65B on auxiliary circuit board 70.

Figure 6:
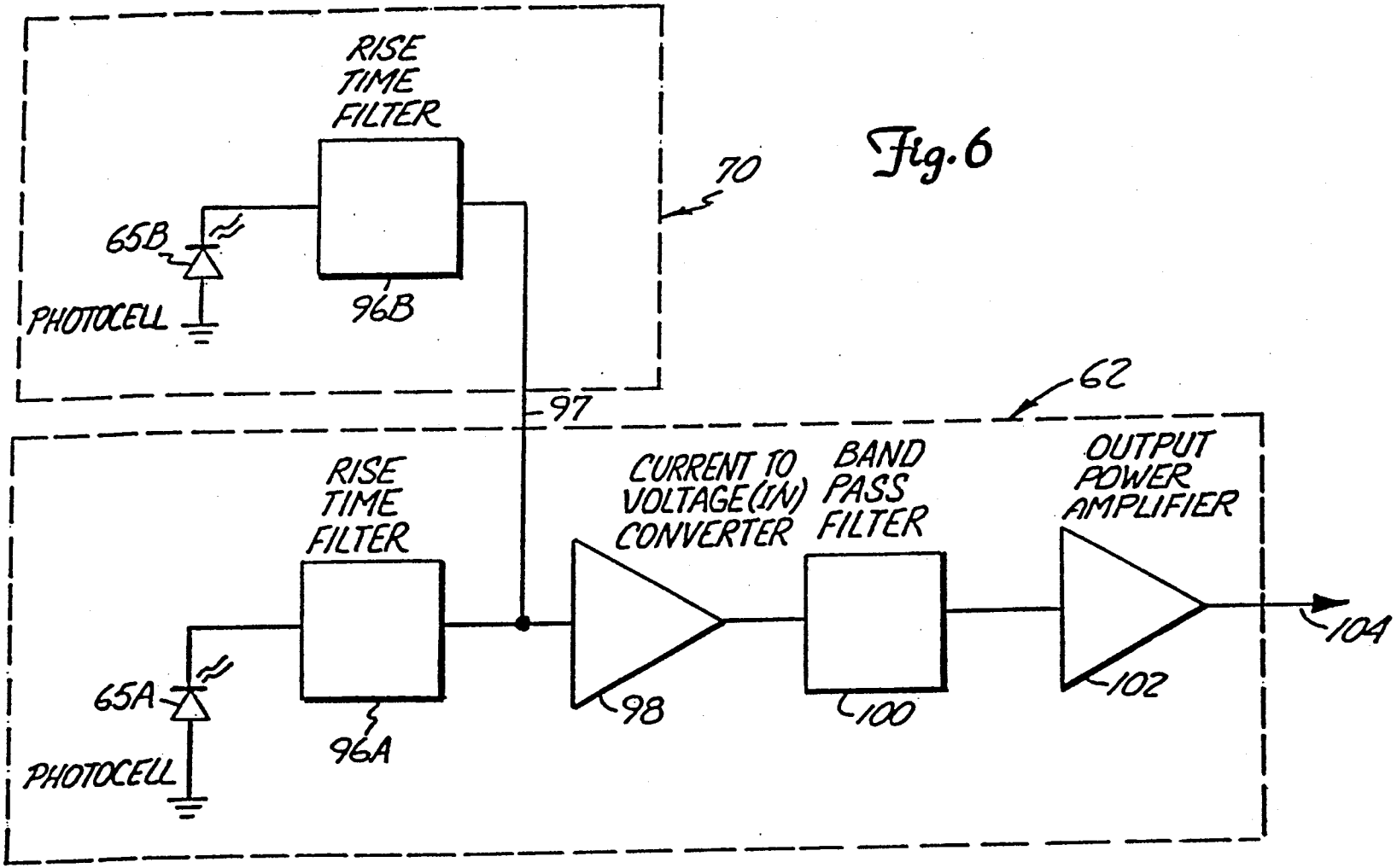
FIG. 6 is a block diagram of the circuitry contained on the master circuit board and the auxiliary circuit board of the detector assembly of FIG. 2.

FIG. 6 is a block diagram of the circuitry included on fully populated master circuit board 62 and partially populated circuit board 70 similar to those shown in detector assembly 16 of FIG. 2. The circuitry includes photocells 65A and 65B, rise time filters 96A and 96B, circuit node 97, current-to-voltage (I/V) converter 98, band pass filter 100, output power amplifier 102 and detector channel output 104.

Photocells 65A and 65B receive pulses of light from an emergency vehicle. Rise time filters 96A and 96B allow only quickly changing signals caused by pulses of light to pass. Rise time filters 96A and 96B are high pass filters tuned to a specific frequency, such as 2 KHz.

Each rise time filter 96A and 96B produces an electrical signal having a current that represents a pulse of light received by a photocell. Circuit node 97 sums the currents produced by rise time filters 96A and 96B. Although the embodiment shown in FIG. 6 only has two photocells, circuit node 97 makes it possible to have additional photocells on the same detector channel; an advancement over the prior art where a resonant frequency had to be tuned based on the number of photocells.

I/V converter 98 converts the current signal summed by circuit node 97 into a voltage signal, which can be processed more conveniently than a current signal. Band pass filter 100 isolates a decaying sinusoid signal from the spectrum of frequencies present in the pulse signal generated by a photocell and a rise time filter in response to a pulse of light. Output power amplifier 102 amplifies the decaying sinusoid signal isolated by band pass filter 100 and provides detector channel output 104 to phase selector 17 of FIG. 1. For each pulse of light received by photocell 65A or 65B, detector channel output 104 produces a number of square wave pulses, wherein the number of square wave pulses varies with the intensity of the light pulse received by the photocell.

Figure 7:
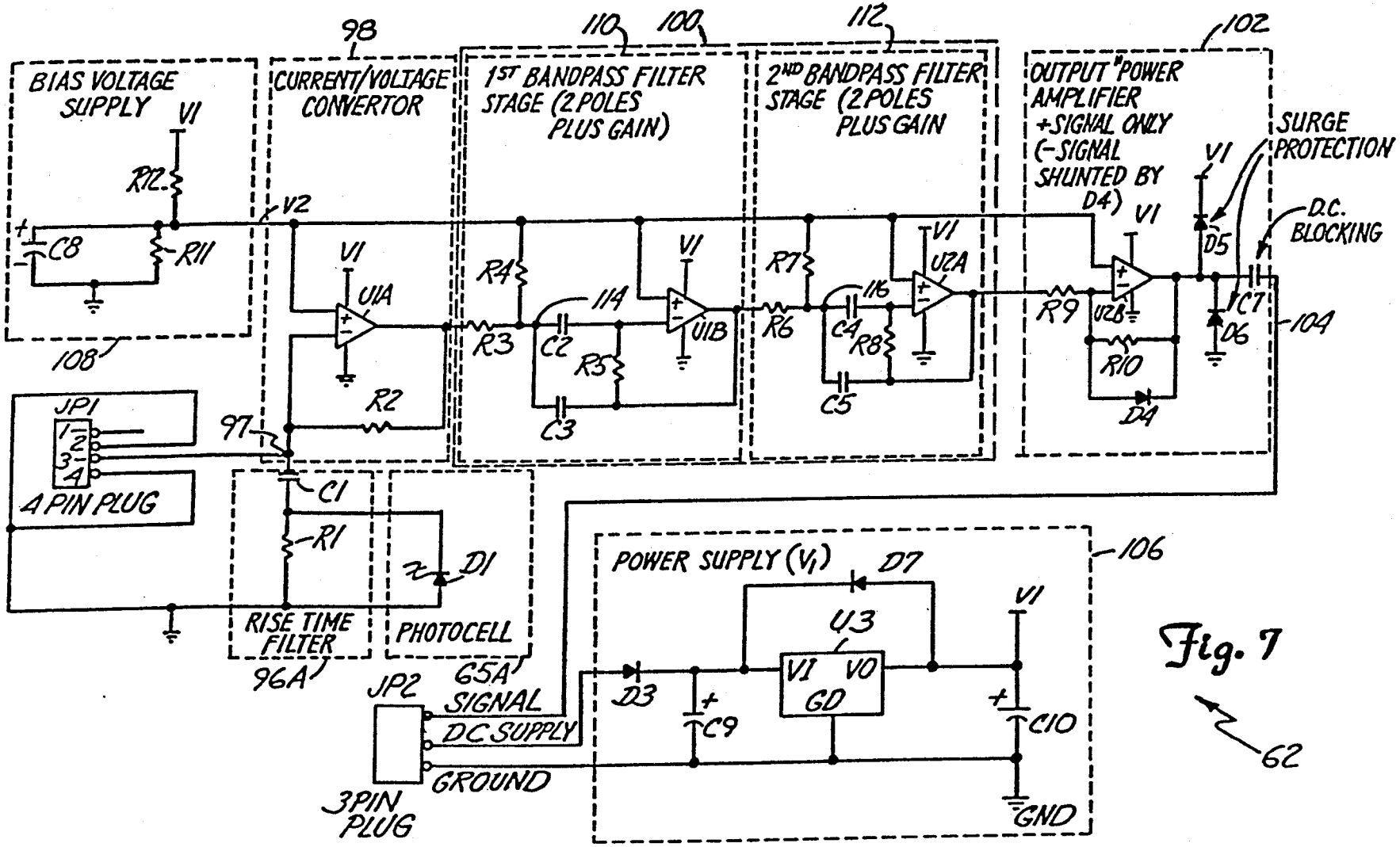
FIG. 7 is a detailed circuit diagram of the master circuit board of FIG. 6.

FIG. 7 is a detailed circuit diagram showing an embodiment of the circuitry included on master circuit board 62 and shown as a block diagram in FIG. 6. In FIG. 7, master circuit board 62 has photocell 65A, rise time filter 96A, circuit node 97, I/V converter 98, band pass filter 100, output power amplifier 102, detector channel output 104, power supply 106, bias voltage supply 108 and connectors JP1 and JP2.

Connector JP2 is a three pin plug that is connected to terminal strip 38 by cable 42 in FIG. 2. Connector JP2 is only connected to a fully populated master circuit board 62 and supplies the board with a DC supply voltage and ground GND. In this embodiment, the DC supply voltage provided by connector JP2 is approximately 26 volts. Connector JP2 also connects detector channel output 104 to terminal strip 38, which is also connected to phase selector 17 of FIG. 1.

Power supply 106 converts a DC supply voltage coming from connector JP2 into a regulated voltage V1. Power supply 106 includes diodes D3 and D7, capacitors C9 and C10, regulator U3 and an output.

The DC supply voltage from connector JP2 is connected to an anode of diode D3. Capacitor C9 is a polarized capacitor with a negative terminal connected to ground GND and a positive terminal connected to the cathode of diode D3. Regulator U3 has input VI, output VO and ground terminal GD. Ground terminal GD is connected to the ground GND. Input VI is connected to the cathode of diode D3. Diode D7 has a cathode connected to input VI of regulator U3 and an anode connected to output VO of regulator U3. Polarized capacitor C10 has a positive terminal connected to output VO of regulator U3 and a negative terminal connected to ground GND. Output VO of regulator U3 provides the output for power supply 106. The output of power supply 106 is supply voltage V1. In this embodiment, V1 is 15 volts. Supply voltage V1 is distributed throughout master circuit board 62, along with ground potential GND from connector JP2.

Bias voltage supply 108 divides supply voltage V1, producing bias voltage V2. In this embodiment, bias voltage V2 is one half of supply voltage V1, or 7.5 volts. Bias potential supply 108 includes resistors R11 and R12 and capacitor C8. The output of bias voltage supply 108 is bias voltage V2.

Resistors R11 and R12 form a voltage divider, with resistor R12 connected between supply voltage V1 and bias voltage V2 and resistor R11 connected between bias voltage V2 and ground GND. Bias voltage supply 108 also has polarized capacitor C8, with a positive terminal connected to bias voltage V2 and a negative terminal connected to ground GND.

Photocell 65A is comprised of photodiode D1. Photodiode D1 operates in a photovoltaic mode and produces a low level current signal when exposed to light. Photodiode D1 has an anode that is connected to ground GND and a cathode that serves as an output of photocell 65A. Photodiode D1 would perform equally well in the circuit of FIG. 7 if the cathode is connected to ground GND and the anode serves as the output of photocell 65A.

Photodiode D1 is a silicon PIN photocell with a relatively small active area of approximately 0.1 inches by 0.09 inches. A relatively small active area is desirable because it tends to minimize variations between photodiodes. Photodiode D1 is mounted to a circuit board with the long axis vertical to minimize the horizontal detection angle and maximize the vertical detection angle.

Although photodiode D1 is used to receive pulses of light from a stroboscopic light mounted on an emergency vehicle, industry standards typically require that electrical specifications be given for a photodiode illuminated with a 2800 degree K tungsten light. Included in the specifications that Photodiode D1 must meet are the following. When irradiated with 100 microwatts/cm$^2$ of 2800 degrees K tungsten light with photodiode D1 at 23 degrees C, photodiode D1 has a forward open circuit voltage of at least 0.250 volts, and a forward current into a 1000 ohm series resistance of at least 1.2 microamps. When no light illuminates photodiode D1, it has a reverse current that does not exceed 1.5 microamps at 1.000+/−0.002 volts DC at 25 +/−3 degrees C. The forward voltage drop of photodiode D1 must not exceed 2.0 volts with an applied 10 milliamp forward current.

Rise time filter 96A is a high pass filter that allows only quickly changing signals to pass. Rise time filter 96A includes resistor R1 and capacitor C1. Resistor R1 has one terminal connected to qround GND and another terminal connected to the output of photocell 65A. Capacitor C1, has one terminal connected to the output of photocell 65A and another terminal that serves as an output for rise time filter 96A.

The output of rise time filter 96A, is connected to I/V converter 98. I/V converter 98 includes operational amplifier (op amp) U1A, resistor R2 and an output. Op amp U1A is powered by connections to supply voltage V1 and ground GND. Op amp U1A has a noninverting input connected to bias voltage V2 and an inverting input connected to the output of rise time filter 96A. Resistor R2 is connected between the inverting input of op amp U1A and an output of op amp U1A. The output of op amp U1A is the output of I/V converter 98.

In the embodiment shown in FIG. 7, band pass filter 100 is implemented as first band pass filter stage 110 and second band pass filter stage 112. The two band pass filter stages 110 and 112 are of nearly identical construction, and a detailed explanation of one applies to the other.

First band pass filter stage 110 has resistors R3, R4 and R5, capacitors C2 and C3, op amp U1B, common node 114, an input and an output. The output of I/V converter 98 is connected to a terminal of resistor R3. This terminal of resistor R3 serves as the input to first band pass filter stage 110. Another terminal of resistor R3 is connected to common node 114. Also connected to common node 114 are a terminal of resistor R4, a terminal of capacitor C2 and a terminal of capacitor C3. Resistor R4 has a second terminal connected to bias voltage V2, capacitor C3 has a second terminal connected to an output of op amp U1B and capacitor C2 has a second terminal connected to an inverting input of op amp U1B. Resistor R5 is connected between the inverting input of op amp U1B and the output of op amp U1B. Op amp U1B is powered by connections to supply voltage V1 and ground GND and has a noninverting input connected to bias voltage supply V2. The output of op amp U1B is also the output of first band pass filter stage 110, and is coupled to an input of second bass pass filter stage 112.

As previously noted, second band pass filter stage 112 is of nearly identical construction to first band pass filter stage 110. Second band pass filter stage 112 has resistors R6, R7 and R8, capacitors C4 and C5, op amp U2A, common node 116, an input and an output. The following components serve equivalent functions in the two band pass filter stages: resistor R3 and resistor R6, resistor R4 and resistor R7, capacitor C2 and capacitor C4, capacitor C3 and capacitor C5, resistor R5 and resistor R8, common node 114 and common node 116 and op amp U1B and op amp U2A.

The output of second band pass filter stage 112, which is the output of op amp U2A, is coupled to output power amplifier 102. Output power amplifier 102 includes resistors R9 and R10, capacitor C7, diodes D4, D5 and D6, op amp U2B and detector channel output 104.

The output of second band pass filter stage 112 connected to a terminal of resistor R9. Another terminal of resistor R9 is connected to an inverting input of op amp U2B. Op amp U2B is powered by connections to supply voltage V1 and ground GND and has a non-inverting input connected to bias voltage V2. Resistor R10 is connected between the inverting input of op amp U2B and an output of op amp U2B. Diode D4 has an anode connected to the inverting input of op amp U2B and a cathode connected to the output of op amp U2B. Diode D5 has an anode connected to the output of op amp U2B and a cathode connected to power supply voltage V1. Diode D6 has an anode connected to ground GND and a cathode connected to the output of op amp U2B. Together, diodes D5 and D6 provide surge protection and insure that the output of output power amplifier 102 is a signal that does not exceed the limits of supply voltage V1 and ground GND. Capacitor C7 is connected between the output of op amp U2B and detector channel output 104. Capacitor C7 removes the DC voltage component from detector channel output 104.

In this embodiment, the circuit of FIG. 7 is constructed with the components listed in Table I.

TABLE I

| | |
|---|---|
| Resistors | |
| R3, R6, R9 | 4.32K Ohms |
| R1, R11, R12 | 7.50K Ohms |
| R2 | 40.2K Ohms |
| R4, R5, R7, R8, R10 | 143K Ohms |
| Diodes | |
| D1 | Photodiode |
| D3, D5, D6, D7 | IN4002 |
| D4 | IN4148 |
| Capacitors | |
| C1 | .01 micro Farad |
| C2, C3, C4, C5 | .0001 micro Farad |
| C7 | .1 micro Farad |
| C10 | 1 micro Farad |
| C8, C9 | 4.7 micro Farad |
| Operation Amplifiers | |
| U1A, U1B, U2A, U2B | MC 33078D |
| Regulator | |
| U3 | LM7815 |

The operation of the circuit of FIG. 7 will be explained in detail with reference to FIGS. 8A-8E, which represent waveforms present in various sections of the circuit of FIG. 7. FIGS. 8A-8E are exaggerated to better illustrate the operation of the circuit of FIG. 7, and therefore, the scale and timing of FIGS. 8A-8E are not an exact depiction of the actual waveforms.

Figure 8A:
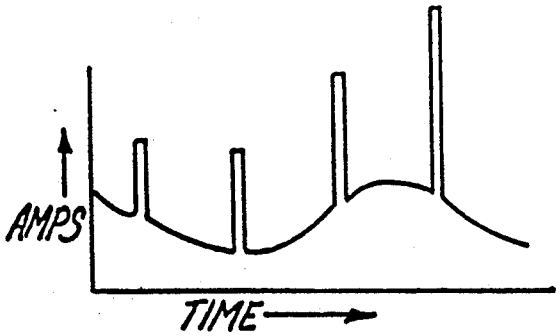
FIGS. 8A–8E are graphs of the waveforms present at various stages in the circuitry of master circuit board of FIG. 7.

Photodiode D1 of photocell 65A operates in a photovoltaic mode. In this mode, photodiode D1 produces a small electrical current that varies with the amount of light it receives. FIG. 8A is a graph showing a typical current signal coming from photodiode D1 as an approaching emergency vehicle (as shown in FIG. 1) is emitting pulses of light to preempt the normal sequence of traffic signal lights 12 of FIG. 1.

As seen in FIG. 8A, the signal from photodiode D1 has a constant component (due to street lights, daylight and other constant sources), a slowly varying component (due to approaching car headlights and other slowly varying sources) and a quickly changing component (due to the pulses of light emitted by an approaching emergency vehicle). The pulses of light emitted by the approaching emergency vehicle are several microseconds in duration and are repeated at a predetermined rate, such as 10 pulses per second.

Figure 8B:
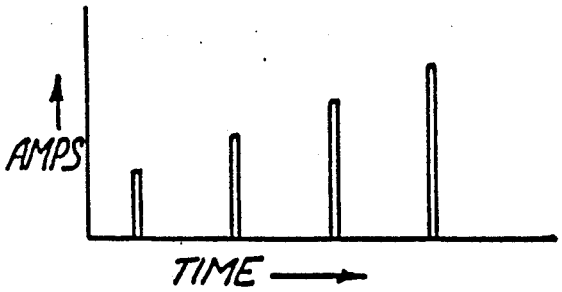

The output of photocell 65A is presented to rise time filter 96A. As seen in FIG. 8B, rise time filter 65A eliminates the constant and slowly varying components of the signal emitted by photodiode D1 shown in FIG. 8A.

An important advantage of this invention is that it allows a variable number of photocells to be placed on the same detector channel. At circuit node 97, the output of another photocell and rise time filter connected to pin 3 of connector JP1 can be summed with the output of photocell 65A and rise time filter 96A.

The circuit of FIG. 7 shows a fully populated master circuit board 62. However, if a second photocell 65B is to be added on the same channel, it is mounted on a partially populated auxiliary circuit board 70 (as shown in FIGS. 2, 5B and 6). The only components from FIG. 7 that are on an auxiliary circuit board 70 are photocell 65B, rise time filter 96B and four pin plug connector JP1. Cable 66 (shown in FIG. 2) connects connector JP1 on a master circuit board 62 to connector JP1 on an auxiliary circuit board 70. Node 97 sums the current signals produced by the pair of photocells 65A and 65B and rise time filters 96A and 96B.

Figure 8C:
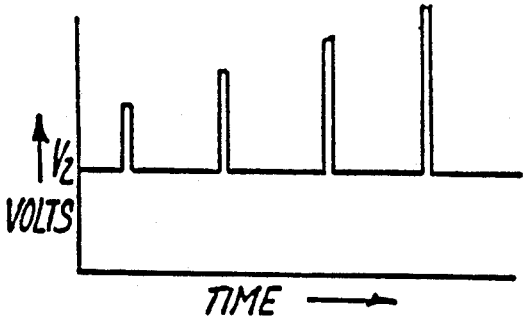

The current output of at least one rise time filter 96A or 96B is coupled to the input of I/V converter 98. As seen in FIG. 8C, I/V converter 98 produces a series of voltage pulses imposed on a constant voltage equal to bias voltage V2. These voltage pulses are applied to band pass filter 100.

Band pass filter 100 is comprised of first band pass filter stage 110 and second band pass filter stage 112. Each band pass filter stage 110 and 112 has two poles plus a gain. The combined effect of the two band pass filter stages 110 and 112 is to provide a greater roll-off from the center frequency than would a single band pass filter stage. This provides superior rejection of 60 Hz and 120 Hz signals.

Figure 8D:
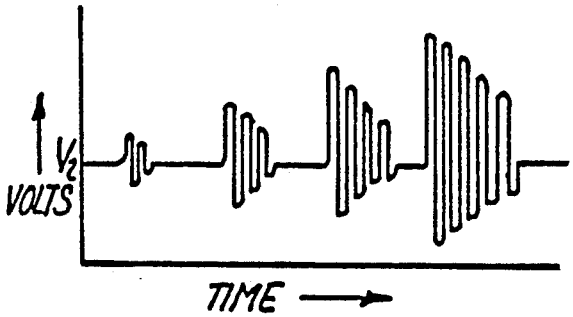

FIG. 8D is an illustration of the signal produced by band pass filter 100. Band pass filter 100 receives the voltage pulses shown in FIG. 8C and isolates a decaying sinusoid signal from the spectrum of frequencies contained in a voltage pulse. In this embodiment, band pass filter 100 has a center frequency of approximately 6.5 KHz.

Figure 8E:
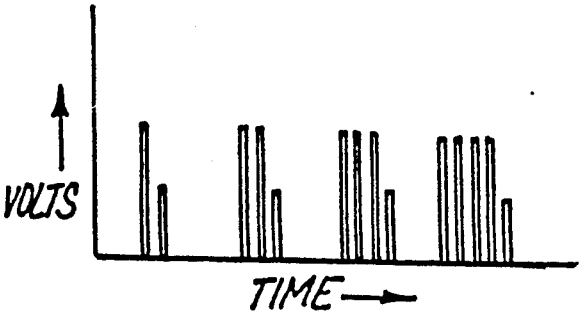

The decaying sinusoid signal produced by band pass filter 100 is applied to output power amplifier 102. Output power amplifier 102 has diode D4, which shunts a portion of the signal from band pass filter 100 that is below bias voltage V2. Additionally, the combined effect of the gain stages of first band pass filter stage 110, second band pass filter stage 112 and output power amplifier 102 is to amplify the decaying sinusoid signal until it reaches the limits imposed by supply voltage V1 and ground GND. FIG. 8E shows the net effect of retaining only the positive component of the signal and amplifying the signal to the limits of the range of op amp U2B.

FIG. 8E also shows the signal that the circuit of FIG. 7 transmits to phase selector 17 of FIG. 1. FIG. 8E shows a series of pulse packets, with each pulse packet corresponding to a single pulse of light emitted from the approaching emergency vehicle. As the emergency vehicle approaches, the number of pulses per packet transmitted by the circuit of FIG. 7 will increase. In general, the amplitude of the pulses will be equal to the maximum output of output power amplifier 102. However, there may be one pulse at the end of a decaying sinusoid signal of such a small magnitude that it is not amplified to the maximum output of output power amplifier 102, thereby producing a smaller pulse. FIG. 8E shows such a smaller pulse at the last pulse of each pulse packet in FIG. 8E.

Phase selector 17 of FIG. 1 can determine the distance of an approaching vehicle by counting the number of pulses per packet. With this information, phase selector 17 can request traffic signal controller 14 to preempt a normal traffic control light sequence and signal cross traffic to stop and the approaching emergency vehicle to proceed through the intersection.

This invention has been developed for use as part of an Opticom Priority Control System, manufactured by Minnesota Mining and Manufacturing Company. The Opticom system is similar to a system disclosed by Long in U.S. Pat. No. 3,550,078. The present invention provides a signal that is compatible with previously installed Opticom systems.

Besides signal format compatibility, this invention provides an increase in range over prior Opticom detectors. Prior Opticom detectors could not detect an approaching emergency vehicle until it was within 1800 feet of the detector. This invention provides an Opticom system with greater range without having to replace the rest of the system; only the detector assemblies need to be replaced.

This invention achieves greater range than prior Opticom detectors by increasing the sensitivity and signal-to-noise ratio of the detector channel. Several factors contribute to these improvements. First, a lens is placed over the photocell, intensifying or concentrating the light received by the photocell and reducing the area of the photocell (which reduces noise generated by the photocell). Second, the inductor used in prior art circuits has been removed. The inductor acted as a large antenna and induced noise into the detector channel. The inductor also required extensive shielding, adding cost and complexity to a detector channel. Third, the components are on a surface mounted board in proximity to the photodiode, reducing the distance that an unamplified signal has to travel before being amplified and thereby reducing the ability of noise to be induced into the circuit. In prior detectors, the detector circuitry was placed in the base of the detector assembly, not close to the photocells.

Another advantage of this invention is increased modularity. In prior detectors, each detector channel had to have two photocells. If an approach to an intersection required its own channel, both photocells where aimed in the same direction. Additionally, prior detectors allowed only one channel per detector assembly. Therefore each detector assembly had two photocells and one channel.

This invention allows a variable number of detectors per channel, and a variable number of channels per detector assembly. By replacing the resonant circuit, which depended on having two photocells to provide the required capacitance, with a rise time filter and a I/V converter, any number of photocells can be connected to a channel. By putting the circuitry associated with a detector channel on a single board with the photocell, multiple detector channels can be placed in the same assembly.

Although the present invention has been described with reference to preferred embodiments, workers skilled in the art will recognize that changes may be made in form and detail without departing from the spirit and scope of the invention.

What is claimed is:

1. A detector for receiving pulses of light from an emergency vehicle and sending an output signal to a remote phase selector, the detector comprising:

photocell means for providing an electrical signal in response to pulses of light received;

rise time filter means coupled to the photocell means for removing constant and slowly varying components from the electrical signal provided by the photocell means and allowing quickly changing pulse components of the electrical signal to pass;

band pass filter means coupled to the rise time filter means for generating a decaying packet of electrical pulses from each pulse provided by said rise time filter means; and output means coupled to the band pass filter means for providing the output signal based upon the decaying packet pulses, whereby the amplitude of each received pulse of light is represented in said output signal as said packet of electrical pulses in which the number of successive pulses and amplitude of the final pulse in each packet represents the amplitude of the corresponding received pulse of light so that the output signal can have a relatively low maximum level consistent with integrated circuits and still be relatively immune to noise sources present in transmission lines coupling the detector to said remote phase selector.

2. The detector of claim 1 wherein the photocell means is a photodiode.

3. The detector of claim 2 wherein the photodiode operates in a photovoltaic mode and the electrical signal provided by the photocell means is a current signal that varies with the intensity of light striking the photocell means.

4. The detector of claim 3 wherein the rise time filter means comprises a capacitance and a resistance.

5. The detector of claim 4 wherein the photodiode has a first terminal and a second terminal, with the first terminal connected to ground, the resistance has a first terminal and a second terminal, with the first terminal connected to ground and the second terminal connected to the second terminal of the photodiode, and the capacitance has a first terminal and a second terminal, with the first terminal of the capacitance connected to the second terminal of the photodiode and the second terminal of the capacitance serving as an output of the rise time filter means.

6. The detector of claim 5 wherein the capacitance and the resistance form a high pass filter that removes from the current signal provided by the photocell means frequency components below approximately two kilohertz.

7. The detector of claim 1 wherein the band pass filter means has a center frequency.

8. The detector of claim 7 wherein the center frequency is approximately 6.5 kilohertz.

9. The detector of claim 1 wherein the band pass filter comprises first and second band pass filter stages.

10. The detector of claim 9 wherein each band pass filter stage comprises:

an operational amplifier having an inverting input, a non-inverting input and an output, wherein the non-inverting input is connected to a bias voltage and the output also serves as an output for the band pass filter stage;

a first resistor connected between the output of the operational amplifier and the inverting input of the operational amplifier;

a second resistor connected between an input to the band pass filter stage and a common node;

a third resistor connected between the bias voltage and the common node;

a first capacitor connected between the output of the operational amplifier and the common node; and a second capacitor connected between the inverting input of the operational amplifier and the common node.

11. The detector of claim 1 wherein the output means comprises:

output power amplifier means, for providing an output signal capable of being received by a phase selector not in proximity to the detector.

12. The detector of claim 11 wherein the output means further comprises:

shunting means for removing a negative component from the output signal of the output power amplifier means.

13. The detector of claim 11 wherein the output means further comprises:

surge protection means for preventing the output signal of the output power amplifier means from exceeding limits imposed by a ground voltage and a supply voltage.

14. The detector of claim 11 wherein the output means further comprises:

direct current blocking means, for removing a bias voltage from the output signal of the output power amplifier means.

15. The detector of claim 11 wherein the output power amplifier means comprises:

an operational amplifier having an inverting input, a non-inverting input and an output, wherein the non-inverting input is connected to a bias voltage and the output also serves as an output for the output power amplifier means;

a first resistor connected between the output of the operational amplifier and the inverting input of the operational amplifier;

a first diode with an anode connected to the inverting input of the operational amplifier and a cathode connected to the output of the operational amplifier;

a second resistor connected between the inverting input of the operational amplifier and an input to the output power amplifier means.

16. The detector of claim 15 wherein the output power amplifier means further comprises:

a second diode with an anode connected to the output of the operational amplifier and a cathode connected to a supply voltage; and a third diode with an anode connected to a ground voltage and a cathode connected to the output of the operational amplifier.

17. The detector of claim 15 and further comprising:

a second capacitor connected between the output of the output power amplifier means and the phase selector.

18. A detector channel for receiving pulses of light from an emergency vehicle and sending a signal to a remote phase selector, the detector comprising:

first photocell means for providing an electrical signal that varies with an intensity of light striking the first photocell means;

first rise time means coupled to the first photocell means for removing constant and slowly varying components from the electrical signal provided by the first photocell means and allowing quickly changing pulse components of the electrical signal to pass;

summing means coupled to the first rise time filter means for combining an output from additional rise time filter means with an output from the first rise time filter means;

band pass filter means coupled to the summing means for generating a decaying packet of pulses from each pulse provided by the summing means; and output means coupled to the band pass filter means for producing the output signal based upon the decaying packet pulses, whereby the amplitude of each received pulse of light is represented in said output signal as said packet of pulses in which the number of successive pulses and amplitude of the final pulse in each packet represents the amplitude of the corresponding received pulse of light so that the output signal can have a relatively low maximum level consistent with integrated circuits and still be relatively immune to noise sources present in transmission lines coupling the detector to said remote phase selector.

19. The detector of claim 18 wherein the summing means comprises:

a circuit node that receives current signals from rise time filter means and provides an output current signal that represents the sum of the received currents; and current-to-voltage converter means, for receiving the output current signal of the circuit node and providing an output voltage signal representative of the output current signal of the circuit node.

20. The detector of claim 19 wherein the current-to-voltage converter means comprises:

an operational amplifier having an inverting input, a non-inverting input and an output, wherein the inverting input serves as an input to the current to voltage converter means, the noninverting inverting input is connected to a bias voltage and the output serves as an output of the current to voltage converter means; and a resistor connected between the output of the operational amplifier and the inverting input of the operational amplifier.

21. The detector of claim 18 and further comprising:

second photocell means, for providing an electrical signal that varies with an intensity of light striking the second photocell means; and second rise time filter means coupled to the second photocell means and the summing means, for removing constant and slowly varying components from the electrical signal provided by the second photocell means and allowing quickly changing pulse components of the electrical signal to pass.

* * * * *